United States Patent [19]

Leitermann et al.

[11] Patent Number: 4,467,150

[45] Date of Patent: Aug. 21, 1984

[54] ELECTRONIC KEYBOARD

[75] Inventors: Richard Leitermann, Brighton; Bruce G. Wilson, Sudbury, both of Mass.

[73] Assignee: Digital Equipment Corporation, Maynard, Mass.

[21] Appl. No.: 351,719

[22] Filed: Feb. 24, 1982

[51] Int. Cl.[3] ..... H01H 9/00

[52] U.S. Cl. ..... 200/5 A; 200/159 B; 200/292; 361/398; 400/479; 400/488

[58] Field of Search ..... 200/5 R, 5 A, 5 B, 5 C, 200/5 D, 5 E, 5 EA, 5 EB, 5 F, 159 R, 159 A, 159 B, 292, 333, 340; 400/479, 488, 479.1, 477, 490, 495, 496; 340/365 R, 365 A, 365 C, 365 E, 365 L, 365 P, 365 S; 361/398; 179/90 K, 179

[56] References Cited

U.S. PATENT DOCUMENTS 3,909,564 9/1975 Sheingold et al. ..... 200/292 X
3,917,917 11/1975 Murata ..... 200/5 R X
4,066,851 1/1978 White et al. ..... 200/5 A
4,271,333 6/1981 Adams et al. ..... 200/5 A X
4,363,942 12/1982 Deeg et al. ..... 200/159 R X

*Primary Examiner*—E. A. Goldberg
*Assistant Examiner*—Morris Ginsburg
*Attorney, Agent, or Firm*—Cesari and McKenna

[57] ABSTRACT

An electronic keyboard includes a base defining a surface having a plurality of faces oriented at different angles. A flexible printed circuit defining rows of switches is disposed on the base surface and rows of switch actuators are disposed on the printed circuit. The actuators comprise key guide strips which define key positions offset along the rows from the switch positions and spring strips which bridge the key and switch positions so that, when keys slidably mounted in the key guide strips are depressed, they close the associated switches. The spring strips are designed to produce minimum operator fatigue and all of the keyboard components coact to give the keyboard a very low profile.

16 Claims, 15 Drawing Figures

ELECTRONIC KEYBOARD

This invention relates to a keyboard. It relates more particularly to an electronic keyboard used to control the transmission of information. Such keyboards are used, for example, to apply data to a computer, to control a printer or to control information being displayed on a video terminal.

BACKGROUND OF THE INVENTION

Conventional electronic keyboards usually comprise a base which supports a matrix board that defines the keyboard's key positions. Each position includes a pair of switch contacts, a spring-biased plunger and a key cap for depressing the plunger which thereupon allows the spring contacts to come together. This completes an electrical circuit to initiate a selected function, e.g. the printing of a character associated with the depressed key. Thus, the manufacture of the keyboard as a whole requires the hand assembly of a large number of small parts which is time consuming and expensive. Also, there is ample opportunity for misassembly of those parts. Furthermore, electrical connections have to be made between the switch contacts at the different key positions and a printed circuit board, further adding to the time required to assemble keyboards of this general type.

There do exist membrane keyboards or touch pads which are used in some calculators and in the control panels for some appliances such as radar ovens. See, for example, U.S. Pat. Nos. 3,773,998; 3,978,297; 3,982,081 and 4,028,509. However, those prior apparatus are not entirely suitable as full keyboards for use with a computer, printer, display terminal, or the like. First of all, the "keys" on most of those pads do not move to any appreciable extent. Therefore, they do not provide any feedback to the operator which is desirable if the operator is to "type" accurately at a reasonably high rate of speed. Also the switches incorporated into those prior membrane keyboards at the different key positions are generally not reliable or durable enough for this application and the electrical signals they initiate are not always consistent and uniform.

Those prior pads which do have movable keys tend to require relatively complicated spring structures associated with the keys. Often the keys do not have the right feel as far as the operator is concerned and rapid operator fatigue results.

Also in the usual full keyboard, the key positions are arranged in columns and rows with the rows further away from the front of the keyboard being located at progressively higher levels or elevations like the keys of a conventional typewriter. It has been the convention to regard the second key row or level above the space bar as the so-called home row over which the fingertips are usually returned after reaching for keys in the other rows.

To enable the operator's fingertips to properly contact the keys in the different rows, the tops of the key caps in the different rows have different shapes or profiles. For example, in a typical keyboard, the tops of the key caps in the home row may be more or less horizontal. On the other hand, the tops of the key caps in the topmost row are angled downwardly, the angle being such as to more or less match the angle of the operator's fingertips when he reaches for those keys. Conversely, the key caps in the lowest or front row of the keyboard may be angled upwardly to account for the fact that the operator's fingers have to reach back and down in order to properly depress those keys. This means that several differently sculptured key caps must be manufactured for each keyboard. Not only are there attendant die costs, but also these caps must be separately inventoried and they must be installed in the correct rows of the keyboard, adding to the overall cost of keyboards of this general type.

Also, because the keys are different as aforesaid, each key is dedicated to a particular row or rows of the keyboard. Therefore, it is not possible to change the format of the keyboard by rearranging the keys, e.g. from a telephone format to a calculator format.

Conventional electronic keyboards have other drawbacks as well. Some are excessively noisy in that they emit a clacking sound when the operator rapidly depresses the keys one after the other in the manner of a competent typist. Some prior keyboards of this type do not satisfy the height standard recently agreed upon by European countries which requires that the height of the keys in the home row be no more than 30 mm. from the surface upon which the keyboard rests.

SUMMARY OF THE INVENTION

Accordingly, the present invention aims to provide an improved electronic keyboard for general use.

A further object is to provide such a keyboard which contributes to a minimum extent to operator fatigue.

Another object of the invention is to provide a keyboard of this type which satisfies the European height standard for such apparatus.

A further object of the invention is to provide an electronic keyboard which comprises a minimum number of different parts.

Still another object of the invention is to provide a keyboard of this general type whose components can be assembled quickly and correctly by the average production worker.

A further object of the invention is to provide an electronic keyboard which does not require the individual assembly of small parts at each key position or electrical connections to be made at those positions.

Another object of the invention is to provide an electronic keyboard of this type whose "feel" enables the operator to manipulate the keys of the keyboard at a maximum rate of speed.

A further object is to provide a keyboard which initiates reliable and consistent electrical signals for an associated terminal or computer.

Another object is to provide a keyboard whose keys can be arranged in different formats.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, our keyboard may be a stand-alone item for applying information to a nearby video terminal or directly to a computer. Alternatively, it may be incorporated into the apparatus it is controlling, a so-called intelligent terminal, for example.

The keyboard comprises a base. The floor of the base is formed as an upwardly rearwardly-extending ramp whose slope determines the elevations of the various rows of keys on the keyboard. The ramp may have a uniform slope so that each row of keys is located at a different height or level or more preferably its slope may change so that more than one row of keys is located at the same height or level.

Positioned on that floor is a flexible printed ciruit composed of an upper layer and a lower layer. Printed on opposing faces of these layers are two arrays of registering switch contacts as well as the required connections between those contacts and a set of terminal strips. A dielectric sheet is placed between the two layers and the sheet is formed with openings at the location of each pair of upper and lower switch contacts thereby forming a switch. By pressing down on the circuit at the location of a switch, the upper switch contact is pushed through the registering sheet opening so as to engage the lower contact and close the switch. Upon removal of pressure, the switch opens. In accordance with the usual keyboard format, the switch positions are arranged in rows, e.g. five rows, there being, say, up to twenty switch positions in a typical row.

A spring strip covers each row of switches formed by the printed circuit. Each such strip comprises a lengthwise series of cantilevered spring members, there usually being one member for each switch. Superimposed on each row of spring strips is a key guide strip. Each guide strip defines a lengthwise series of key guides, there usually being one such guide for each switch. Means are provided for anchoring the key guide strips to the base through the spring strips and printed circuit to maintain the proper relative positions of all of those components.

A key is positioned in each key guide. Each key is composed of a key cap accessible at the top of the keyboard and an integral plunger which is slidably received in a key guide and engages the free end of an underlying spring member. Normally, the key cap is supported at an elevated position by its engaged spring member. However, each key can be depressed so as to flex its spring member downwardly toward the underlying printed circuit. As will be described in detail later, each key is formed with a clip which engages the associated key guide strip so as to releasably retain the key in its key guide and which permits the key to move between its elevated and depressed positions.

The key positions in each row which are defined by the locations of the key guides in that row are offset along the row from the switches in that same row. Furthermore, each spring member in the row bridges a switch on the flexible circuit. Thus when a particular key cap is depressed, its engaged spring member is flexed into contact with the printed circuit at the location of a switch. A small depending dimple on the spring member flexes the printed circuit enough to close that switch so long as the associated key cap remains depressed. As soon as the cap is released, it returns to its normal position under the restoring force of the engaged spring member. Since the pressure on the flexible circuit is now relieved, the switch therein opens.

It is important to note that in the present keyboard, force is not transmitted directly from the key caps to the switches in the printed circuits, but rather indirectly through the spring strips. As will be described in detail later, these strips are designed to assure that a substantially constant flexing or switch closing force is applied to the printed circuit even though the depressing forces applied to the key caps may vary.

Resultantly, the electrical signals initiated by the keyboard are consistent and reliable. Also, this construction is found to provide the desired operator feedback from the keys to enable the operator to type correctly at a maximum rate of speed without suffering undue fatigue.

In the present keyboard, all of the keys have exactly the same shape so that they can be formed in a single mold. That is, the tops of the key caps on all of the keys have exactly the same contour or angle. This is possible because of the ramped construction of the keyboard base. By properly selecting the ramp angle under each row of key guide strips, the key caps in those strips can be tilted to the optimum angle for that particular row. Moreover, any key can be used at any location on the keyboard. Accordingly, the character format of the keyboard can be changed at will simply by moving the keys around.

Also, as will be described in more detail later, means are provided on the keys and key guide strips which act to absorb impact forces when the keys are depressed to help provide the desired operator feedback so that the keyboard has the desired feel as far as the operator is concerned.

The forming of the keyboard using a flexible printed circuit and sets of spring strips, key guide strips and keys to define the key positions at the different rows or levels of the keyboard results in a drastic reduction in the number of separate parts required to make the keyboard, as compared with prior comparable electronic keyboards of this general type. In fact, a parts reduction of as much as two-thirds is not uncommon. This not only means a considerable savings in manufacturing cost; it also means that the keyboards themselves can be assembled very quickly and correctly by the average production worker. Furthermore, the assembly can be done without any special tools or equipment, other than a tool for connecting the key guide strips to the base.

Also, the forming of the key positions at the different rows or levels of the keyboard using sets of spring strips and key guide strips means that the same basic units can be employed to form a keyboard having different keyboard formats. For example, in one application, the keys in the keyboard may be arranged in the same format as the keys of a typewriter with the space bar being located in the bottom row. In another application, the key guides and springs and keys can be arranged in a format similar to a calculator pad or panel. Since the shape or sculpturing of all of the keys is the same, a key bearing any character such as the number 7 for example can be used in different rows of the keyboard for those two different keyboard formats.

The keyboard includes a cover which fits on the base and, if desired, that cover may be designed to fill any unused or inactive key positions on the keyboard for those different applications.

With all of these advantages, then, our keyboard should find wide application in connection with the transferring, printing, computing, or displaying of graphic information or data.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
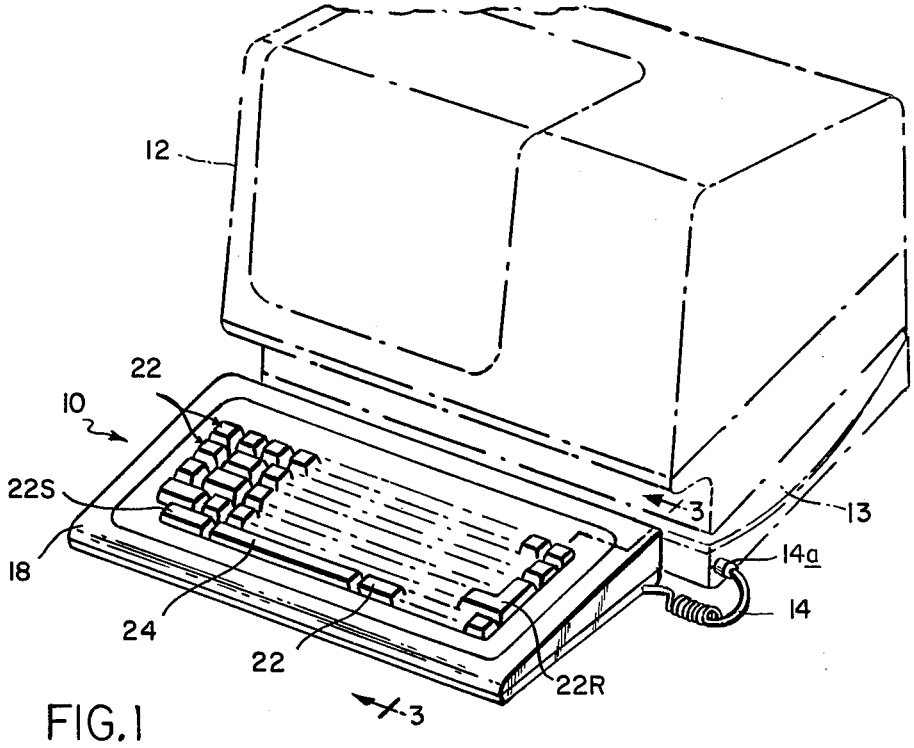
FIG. 1 is perspective view of an electronic keyboard embodying the principles of this invention shown in conjunction with a video terminal.

Referring to FIG. 1 of the drawings, a keyboard made in accordance with this invention is indicated generally at 10. Keyboard 10 is shown in conjunction with a conventional video terminal 12 such as the Model VT100 terminal marketed by Digital Equipment Corporation of Maynard, Mass. Terminal 12 is positioned on an adjustable base 13 which is preferably of the type described in U.S. application Ser. No. 330,716, filed Dec. 14, 1981, entitled IMPROVED TILT SWIVEL BASE which is owned by the assignee of the present application. It should be understood, however, that the keyboard can also be used to provide a direct input to a computer or to control a printer or be incorporated directly into other electronic apparatus such as an "intelligent" terminal. Also the keyboard 10 may have its own microprocessor.

The illustrated keyboard is connected electrically to terminal 12 by way of base 13 by a cable 14 extending from the terminal and terminated by a plug 14*a* which plugs into a receptacle in the base. Both the keyboard and terminal are usually connected electrically to a remote computer (not shown). The cable 14 is secured in a cable trough 15 (FIG. 3) in the underside of the base which extends the entire width of the base so that the cable can be brought out from either side of the keyboard.

The keyboard 10 includes a housing 18 which supports a multiplicity of keys 22 and a space bar 24 arranged in a more or less standard typewriter keyboard format having five rows of keys at various elevations with the space bar being in the front row. It will be appreciated, however, that the keyboard can have other key formats. For example, a block of the keys 22, say, at one side of the keyboard, can be organized in a calculator or telephone type arrangement.

As is the case with most keyboards of this general type, keyboard 10 includes certain keys 22 which are so-called character keys and other keys which execute control functions, the RETURN key 22R and SHIFT key 22S being examples of the latter type. There are also certain keys which are able to perform both functions. By depressing one or another of the keys on the keyboard, one can read data into the computer with which the keyboard and terminal are associated or retrieve data from that computer for display on the terminal 12.

Figure 3:
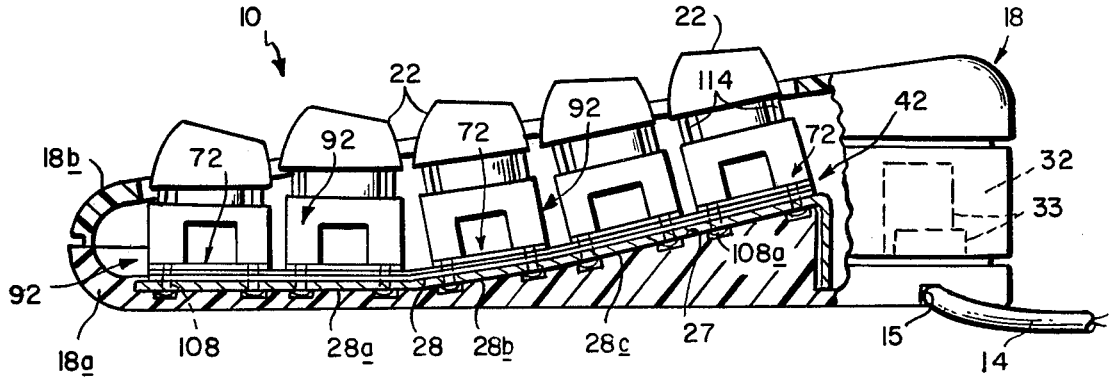
FIG. 3 is a side elevational view on a larger scale with parts broken away of the FIG. 1 keyboard.
Figure 2:
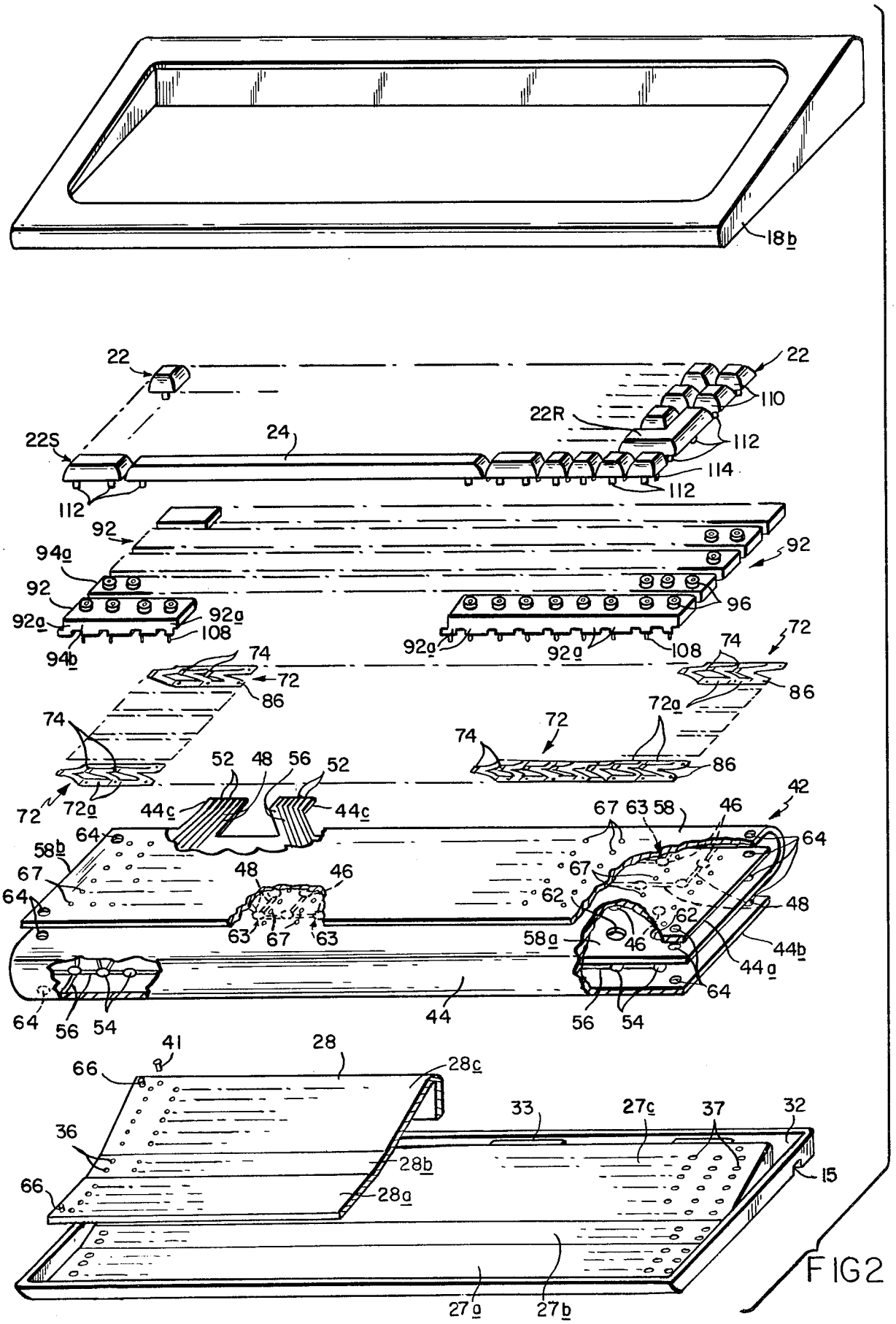
FIG. 2 is an exploded perspective view showing the major components of the FIG. 1 keyboard in greater detail.

Turning now to FIGS. 2 and 3, housing 18 comprises a generally rectangular shell-like lower section or base 18*a* molded of a suitable impact-resistant plastic material. All of the components of the keyboard including the keys 22 are mounted on that base and a shell-like upper section or cover 18*b* is positioned on base 18*a* covering those portions thereof not occupied by keys 22 or space bar 24. Thus all of the components of the terminal except the keys are protectively enclosed within housing 18.

The base 18*a* is formed with a ramped floor 27 which extends from the front of the base upwardly rearwardly as three lengthwise sections or segments 27*a*, 27*b* and 27*c* toward the rear thereof, leaving a relatively wide channel or trough 32 at the rear of the base. This space 32 may be utilized to contain various electrical components associated with the keyboard such as resistors, rheostats, printed circuit boards, electrical connectors, etc., some of which are shown at 33 in FIGS. 2 and 3.

Positioned on floor 27 is a rigid plate 28. This plate is divided into a plurality of lengthwise segments 28*a*, 28*b* and 28*c* which are oriented at different angles relative to the horizontal plane. Plate segment 28*a* which spans the first two rows of keys in the keyboard is more or less horizontal, segment 28*b* supporting the third row of keys is angled up relatively sharply relative to segment 28*a* and segment 28*c* containing the top two rows of keys is oriented at a still larger plane with respect to the horizontal plane. Also as best seen in FIG. 2, the plate 28 is formed with a rectangular array of small vertical holes 36 arranged in columns and rows over all three segments 28*a*, 28*b* and 28*c*. A similar array of dimples 37 are present in the surface of floor 27. Normally, plate 28 is secured to floor 27 by suitable means such as screws 41 (FIG. 2). Alternatively, it may be keyed to the base.

Positioned on base 18*a*, or more particularly, on the plate 28 thereof, is a key position switch-forming printed circuit assembly indicated generally at 42. As shown in FIG. 2, assembly 42 comprises a flexible printed circuit 44 which is folded over on itself about its longitudinal center line so that one longitudinal section 44*a* of the circuit lies directly above the other longitudinal section 44*b* thereof. Printed on the surface of section 44*a* and facing section 44*b* is a rectangular array of conductive switch contacts 46. Also formed on section 44*a* are a multiplicity of electrical paths 48 leading from each contact 46 to one or another of the terminals 52 printed on tabs 44*c* extending from a rear edge of printed circuit 44. Connectors (not shown) electrically connect these terminals to the keyboard cable 14 positioned in cable trough 15 in the underside of the base.

Circuit section 44*b* carries a similar array of switch contacts 54 printed on the surface thereof facing contacts 46. They also are connected to one or another of the terminals 52 by conductive paths 56 printed onto circuit section 44*b*. Alternatively, of course, the two circuit sections 44*a* and 44*b* could be formed separately.

As shown in FIG. 2, the printed circuit assembly 42 also includes an electrically insulating plastic sheet 58 which is more or less the same size and shape as the printed circuit 44. Sheet 58 may be folded about its longitudinal axis and positioned so that its lower section or leaf 58*a* is positioned between printed circuit sections 44*a* and 44*b* as shown in FIG. 2. The other half or section 58*b* of that sheet is folded over on top of circuit section 44*a*. Sheet section 58*a* is formed with a rectangular array of openings 62, the openings being positioned so that they are in register with the switch contacts 46 and 54 on the folded-over printed circuit sections 44*a* and 44*b*. The sheet layer or section 58*a* functions as an insulating spacer between the circuit sections 44*a* and 44*b* except at those locations between the switch contacts 46 and 54. Thus each pair of registering contacts 46 and 54 and the opening 62 between them function as a switch shown generally at 63 in the printed circuit assembly 42. The other half 58*b* of sheet 58 which overlies circuit section 44*a* protects that section from abrasion and improves the operation of the switches as will be discussed later.

Still referring to FIG. 2, locating holes 64 are provided at several places, e.g. the four corners, in the folded-over printed circuit 44. Similar locating holes 64 are formed at the four corners of the folded-over sheet 58 with the openings at the corresponding corners being in register. When the printed circuit assembly 42 is positioned properly on base 18*a*, locating pins 66 projecting up from the four corners of the ramped plate 28 project through the locating holes so as to maintain the alignment of printed circuit 44 and sheet 58. Resultantly, the switch contacts 46 and 54 and the openings 62 of each switch 63 are all in proper register.

Also formed in circuit 44 and sheet 58 are rectangular arrays of small holes 67 arranged in columns and rows corresponding to the array of holes 36 in plate 28. When the assembly 42 is positioned on the plate as aforesaid, the holes 36 and 67 are all in register.

Still referring to FIG. 2, positioned on the printed circuit assembly 42 is a layer of spring strips 72. In the illustrated keyboard having five rows of keys, there are five rows of such spring strips. Each spring strip comprises a plurality of more or less identical sections 72*a*, each such section containing a cantilevered spring 74. The spring strips 72 may be of various lengths depending upon the format of the keyboard 10. For example, the spring strip shown at the right hand end of the first row of strips is seven sections long and contains seven springs 74, while the strip 72 at the left hand end of that same row is three sections long. In general, the strips 72 are arranged so that there is a spring 74 for each active key position on the keyboard.

Figure 5A:
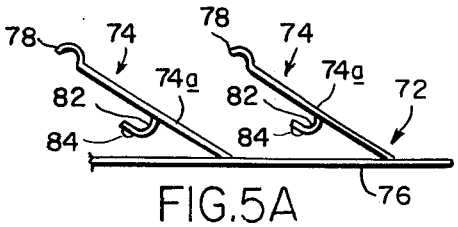
FIGS. 5A and 5B are side elevational and top plan views respectively of a typical spring strip incorporated into the FIG. 1 terminal.
Figure 5B:
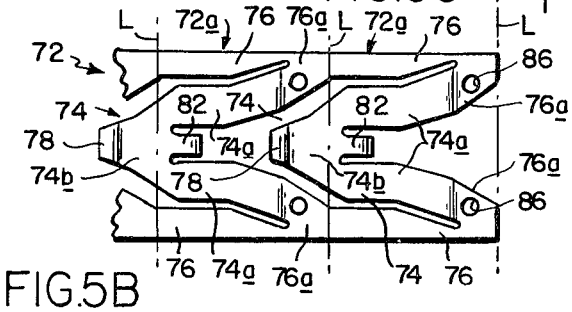

Referring now to FIGS. 5A and 5B, the spring strips 72 are identical except for their length, i.e. the number of sections 72*a* and springs 74 in the strip. In FIG. 5B, the various sections 72*a* are shown bounded by vertical dotted lines L. Each strip is formed from a single piece of spring steel by a conventional etching process or by a stamping process using a progressive die. Thus, the strips can be made in a limited number of fixed lengths. Alternatively, the strip can be formed as a continuous roll with the needed strip lengths being drawn from the roll.

Each spring section 72*a* includes a pair of spaced parallel side rails 76 with the right hand ends of the rails being formed with tabs 76*a* which project toward one another. Each cantilevered spring 74 in each section 72*a* comprises a pair of legs 74*a* whose right hand ends are joined to the tabs 76*a* in that strip section. The spring legs 74*a* are angled toward one another and their opposite ends are connected by a bridging portion 74*b*. Each bridging portion 74*b* has a nose 78 which projects from its leading or upper edge. Furthermore, that nose is upwardly curved or dimpled as best seen in FIG. 5A. The lower edge of the spring bridging portion 74*b* is formed with a small depending tail 82 at the root of the spring legs 74*a*. Tail 82 is hook-shaped, extending downwardly toward the right and then curving back on itself. A dimple 84 is formed at the end of each tail 82 at the underside thereof.

As best seen in FIG. 5B, the legs of the springs 74 are shaped so that when the free end of each spring is depressed, that end fits between the legs of the adjacent spring so that all of the springs operated independently. Also as shown there, a small hole 86 is punched through each strip tab 76*a*. When the strips 72 are arrayed end to end to form a layer of five rows as depicted in FIG. 2 and are properly juxtaposed to the base floor 28, their holes 86 are in register with holes 36 formed in the base. As such, they are also in register with the holes 62 formed in the printed circuit assembly 42.

Referring now to FIGS. 2, 3 and 6A to 6C, positioned above the layer of spring strips 72 is a layer of key guide strips 92. Since there are five rows of spring strips in the illustrated keyboard, there are usually five rows of key guide strips. The strips 92 are molded plastic parts and they are substantially identical except as to their length. Each strip is composed of a plurality of more or less identical sections 92*a*, the division between those sections being shown by the vertical dotted lines L in FIGS. 6B and 6C. The lengths of the various strips 92 in each row of the strip layer depicted in FIG. 2 depend upon the format of the keyboard 10 and whether or not the keyboard has any empty key positions. For example, because of the presence of the space bar 24, the key guide strip 92 at the left end of the front row of the layer shown in FIG. 2 comprises four sections 92*a*. On the other hand, the strip section 92 at the opposite end of that same row is eight sections long. The remaining rows in the layer of key guide strips can be composed of single strips 92 extending the entire length of that row or a plurality of shorter strips laid end to end. Generally, as with the spring strips, the guide strips are made in a limited number of different lengths to save manufacturing and inventory costs.

Figure 6A:
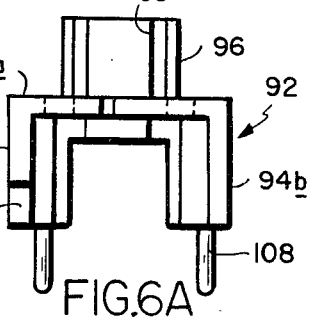
FIGS. 6A to 6C are end elevational, front elevational and top plan views respectively of a typical key guide strip incorporated into the FIG. 1 terminal.
Figure 6B:
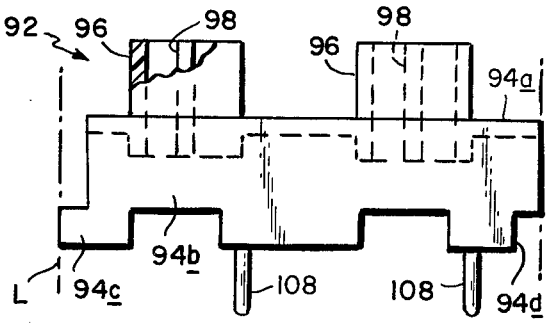
Figure 6C:
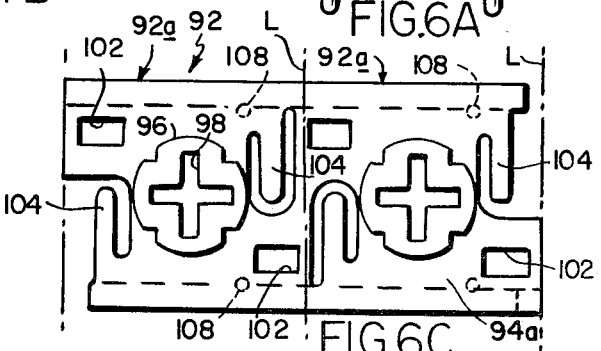

Referring especially to FIGS. 6A to 6C, each key guide strip 92 is a channel-shaped part having a top wall 94*a* and a pair of spaced-apart depending side walls 94*b*. Projecting up from the center of the wall 94*a* in each strip section is a generally cylindrical neck 96. A passage 98 extends down through neck 96 to the underside of the strip, which passage has a cross section which is in the shape of an X or a cross as best seen in FIG. 6C. Formed in diagonally opposite corners of the strip wall 94*a* in each section 92*a* are a pair of small rectangular openings 102. Formed in the remaining two corners of the wall 94*a* in each section 92*a* are a pair of resilient tongues 104. These tongues extend in from the opposite walls 94*b* of the strip parallel to one another on opposite sides of the neck 96 in that section, terminating more or less at the longitudinal center line of the strip.

Figure 4:
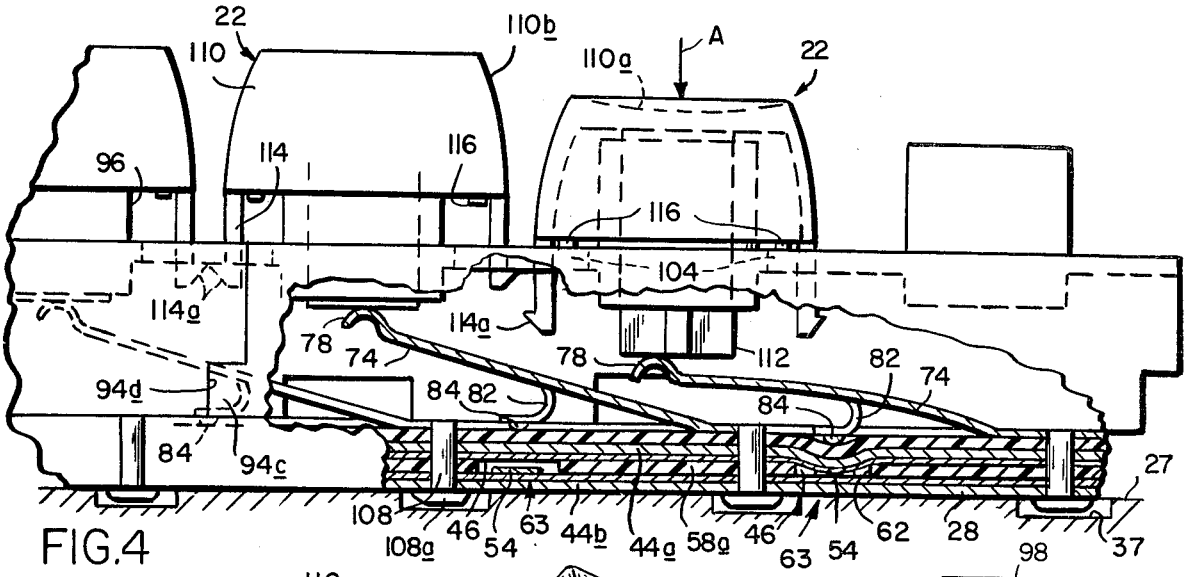
FIG. 4 is a fragmentary front elevational view with parts broken away on a still larger scale illustrating the operation of the FIG. 1 keyboard.

A pair of posts 108 extennd down from the lower edge of strip walls 94*b* in each strip section at points just to the right of the neck 96 in that section. As will be seen later, these posts are used to anchor the components of the keyboard to the base 18*a*. Accordingly, they are dimensioned so that they can project through the openings 86 in spring strips 72 and through the openings 67 in circuit assembly 42, as well as through the openings 36 in plate 28 as best seen in FIG. 4. Thus, since each strip 92 contains at least two strip sections 92*a*, each strip has at least four posts 108.

To facilitate aligning the strips 92 end to end, the end edges of their walls 94*a* and 94*b* may be shaped or stepped so that the opposing ends of adjacent strips interfit or interlock with one another. Thus, as shown in FIG. 6B, the left hand end of the strip front wall 94*b* may have a small foot 94*c* which extends out toward the left, while the right hand end of that same wall may have a small notch 94*d*. It is apparent then that the foot 94*c* can project into the notch 94*d* of a strip positioned in the same row to the left of the illustrated strip, while the notch 94*d* will receive the foot 94*c* of a strip positioned to the right. In a similar fashion, as best seen in FIG. 6C, the opposite ends of the top wall 94*a* in each strip may be stepped so as to mate with correspondingly stepped strips positioned at either end of the illustrated strip 92.

Figure 7A:
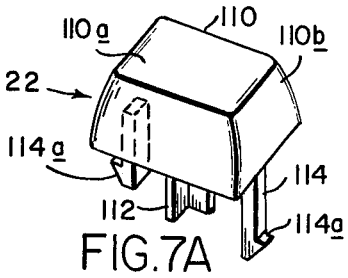
FIGS. 7A and 7B are top and bottom perspective views respectively of the keys utilized in the FIG. 1 terminal.
Figure 7B:
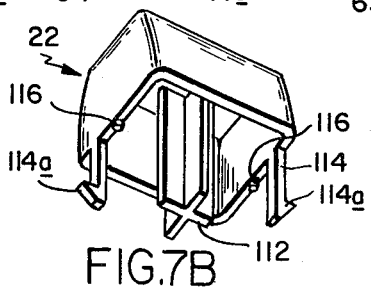

Turning now to FIGS. 7A and 7B, each key 22 comprises a unitary part molded of a suitaable impact-resistant plastic material. It comprises a shell-like key cap 110 having a contoured or sculptured upper surface 110*a* and a shaped skirt 110*b*. Projecting down from the inside of the key cap is a plunger 112 whose cross section is in the shape of an X or a cross. The plunger is dimensioned so that it can be slidably received in the openings 98 of the key guide strips 92.

Extending down from the lower edges of the key cap skirt 110*b* at more or less diametrically opposite locations on the key are a pair of elongated key retainers or clips 114. These are resilient members whose lower ends are terminated by pronounced barbs 114*a* which project out laterally somewhat beyond the key cap skirt. Also extending down from the lower edge of the skirt 110*b* on opposite sides of the plunger 112 are a pair of short posts 116 whose function will be described later.

It is important to note that, unlike the keys in most prior keyboards of this general type, the keys 22 may be identical. That is, the curvature and profile and orientation of the key cap top surface 110*a* can be the same for all keys, as can the shape of the key cap skirts 110*b*. Of course, the key caps may have unique shapes such as the RETURN key 22R shown in FIG. 1 or even non-standard shapes. Therefore, all the keys can be made from the same mold. It is even possible to mold all the keys at once in a single mold after which the individual keys can be separated.

As a direct result of the aforesaid construction and design of the various keyboard components, those components can be assembled to the terminal base 18*a* very quickly and easily. First, the flexible printed circuit 44 is folded over and interleaved with the folded-over spacer sheet 58 as shown in FIG. 2 and that assembly is positioned on the plate 28 using the locating holes and pins 64 and 66 described above. This automatically aligns the holes 67 in the printed circuit assembly 42 with the holes 36 in the plate. With this, the locations of the five rows of key positions in the keyboard are determined.

Next, the key guide strips and spring strips are assembled to the base starting with, say, the top or rear row of keys. Assume, for example, that the top row comprises a single key guide strip 92 and a single spring strip 72 both of which extend the entire length of that row. The spring strip 72 is positioned at the underside of the key guide strip with the guide strip foot 94*c* and springs 74 facing leftward as shown in FIG. 2. The posts 108 projecting down from the key guide strip are then inserted through the holes 86 in the spring strip. This automatically positions the spring strip so that nose 78 at the end of each spring 74 in the strip is centered directly below the plunger passage 98 in a key guide section 92*a* as shown in FIG. 4.

Then the key guide strip with the spring strip impaled thereon is positioned against the plate 28 so that its posts 108 are in register with the holes 67 in the printed circuit assembly and the holes 36 in the plate. The key guide strip is then pressed down toward the base so that the spring strip and circuit assembly are sandwiched between the key guide strip and the base as best seen in FIG. 4. With the guide strip held in that position, the free ends of the posts projecting through the underside of the plate are upset or heatstaked to the underside of the plate as shown at 108*a* in FIGS. 3 and 4. This permanently anchors that top key guide strip and associated spring strip as well as the uppermost lengthwise segment of the circuit assembly 42 to the plate.

The assembler follows the same procedures to mount the other rows of key guide strips and spring strips to the plate. If a particular row is composed of more than one spring strip or more than one key guide strip, those strips are attached to the plate one at a time and in end-to-end relationship so that all of the active key positions in that row of the keyboard are filled. After all of the key guide strips are anchored to the plate, all of the key positions in the keyboard are apparent from the raised necks 96 of those units. The plate 28 can now be mounted to the base 18*a* and secured there by screws 41 (FIG. 2). The dimples 37 in the base floor accommodate the post ends 108*a*. Electrical connections are then made between terminals 52 and cord 14. The only thing that remains is to mount the keys 22 to the key guide strips. This is accomplished simply by positioning a key 22 bearing the particular character at the desired position on the keyboard and inserting its plunger 122 into the neck passage 98 such that the depending key retainers 114 are located opposite the openings 102 in the key guide strip. To facilitate properly orienting the key, the front wall of the key skirt 110*b* has a distinctively broad face as compared with the other skirt walls as shown in FIG. 3. Once the key is in the passage 98, it is simply depressed. This causes the key retainers 114 to project through the openings 102 so that their barbs 114*a* engage under the edges of those openings as best seen in FIG. 4.

Thus the retainers permit the key to be moved vertically between a depressed position wherein the lower edge of the key cap 110 almost touches the top of the key guide strip to a normal or elevated position wherein the retainer barbs 114*a* engage against the underside of the key guide strip top wall 94*a* all as shown in FIG. 4. The tight sliding fit between the X-shaped key guide passages 98 and key plungers 112 minimizes lateral play of the keys and aids in reducing rotational play of the keys. The retainers 114 prevent the keys from falling out of the keyboard during shipping and handling of the keyboard. Yet each key 22 can be removed if need be simply by squeezing its two retainers together until their barbs 114*a* clear the opening 102 edges. The retainers are accessible from the top of the keyboard. To facilitate key removal, a tool which squeezes the retainers together may be used.

Usually there is one spring 74 and one flexible circuit switch 63 associated with each key 22. However, in some cases, it may be desirable that a single key, e.g. a control function key, actuate two or more switches 63. Such a key is located at the left hand end of the front row of the keyboard. That particular key 22S overlies two key strip guide sections 92*a* as well as two springs 74.

Also, while the space bar 24 is essentially a single key, because it is used with great frequency, it is desirable that it control two switches 63 in the flexible circuit assembly 42. These switches are connected in parallel so that those switches are in essence redundant. Therefore, in the event that there is an open circuit or failure of one switch 63, the space bar will still operate. In the illustrated keyboard as shown in FIG. 2, the space bar 24 has plungers 112 projecting down from its opposite ends. These slidably engage in the key guide strip sections 92*a* directly below the opposite ends of the space bar.

It should also be mentioned at this point that, as best seen in FIG. 4, the spring 74 flexed by the depressed key 22 in each key guide strip section 92*a* is actually anchored to the key guide strip section 92*a* to the right of the depressed key position. Therefore, as shown in that figure, the key guide strip sections 92*a* at the right hand ends of the keyboard rows simply serve to anchor the right hand ends of the spring strips. They do not define active key positions and, in fact, those sections do not even support keys. Rather, they may be covered over by the right hand end of the keyboard housing cover 18*b*. The same is true of the last guide section 92*a* under the left end of the space bar 24 in FIG. 2. By the same token, there are no springs 74 anchored under the key guide strip sections at the extreme left end of each row of the keyboard. This offset arrangement of the springs permits the replacement of one double key such as key 22S with two single keys 22 at the same location.

Referring now to FIG. 4, in any given row on the keyboard, the plunger 112 of each key is located directly over the nose 78 of a spring 74 in the same row. Moreover, the tail dimple 84 on each spring is located directly above a printed circuit switch 63 in that row. When a particular key 22 is in its raised position as shown in FIG. 4, the corresponding spring 74 is in its raised unflexed position with its tail 82 spaced slightly from the top of the flexible printed circuit assembly 42 at the associated switch 63. Accordingly, the two contacts 46 and 54 of that switch are spaced from one another because of the presence of the spacer sheet section 58*a* in the assembly. Therefore, that switch 63 remains open.

Each spring 74 is sufficiently stiff and resilient to support quite easily the full weight of the associated key 22. Therefore, that key is normally maintained in its raised position shown in FIG. 4 so that the corresponding switch 63 in the printed circuit assembly is normally open.

On the other hand, when a key 22 is depressed as indicated by the arrow A in FIG. 4, the associated spring 74 is flexed downwardly. This causes its tail 82 or more particularly its dimple 84 to depress the top of the printed circuit assembly 42 at the associated switch 63 so that the contact 46 of that switch is pressed against contact 54, thereby closing that switch.

Thus, as the various keys 22 in the keyboard 10 are depressed and released, various switches 63 in the printed circuit assembly 42 are opened and closed correspondingly. This switching action in the keyboard initiates control signals for the associated terminal 12 (FIG. 1) and for the computer to which the keyboard is connected in a manner similar to other conventional electronic keyboards.

It is important to note that each spring 74 is constructed so that its tail 82 which engages the circuit assembly 42 is offset along the same row from the spring nose 78 which is engaged by the associated key 22. Accordingly, when the key is depressed, it does not apply any force directly to the circuit assembly; it simply flexes the spring downwardly. It is the flexed spring which applies the downward force to the circuit assembly. In this, each cantilevered spring 74 functions more or less as a lever so that a moderate amount of downward force on the free end of the spring results in the application of a larger force by the tail 84 to the associated printed circuit switch 63 located closer to the spring fulcrum. This enables the operator to depress the key using a moderate amount of finger pressure, yet assuredly close the associated switch. We should mention in this connection that the sheet layer 58*b* contacted by each spring when a key is struck helps to distribute the impact force over the appropriate switch 63 area of the upper circuit section 44*a*. This further assures that good electrical contact is made between each pair of switch contacts 46 and 54.

By the same token as the printed circuit is flexed, when each key is depressed, there is minimum shock force transmitted back to the operator's finger. Consequently, the operator can use the keyboard for a prolonged period without suffering undue fatigue. Moreover, because of the illustrated offset key and spring construction, the force which presses each switch contact 46 against contact 54 at each switch position 63 can be controlled to a great extent by properly selecting the dimensions and stiffness of spring 74. Furthermore, the forces exerted by the springs at all switches 63 of assembly 42 will remain more or less the same even though the depressing forces on the keys 22 may vary. This assures that the momentary electrical connections made by the keyboard and the resultant initiated electrical signals are consistent and reliable even though operators having different "touches" use the keyboard. This arrangement also enables the keyboard to provide a proper amount of mechanical feedback to the operator when the keys are depressed so that the unit has the desired "feel" as far as the operator is concerned. In addition, the offset key and spring arrangement enables the entire keyboard to be housed in a very low profile package.

Figure 5C:
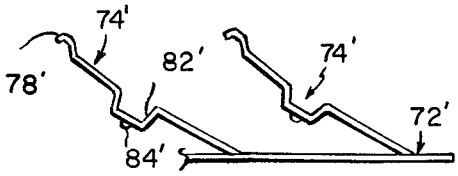
FIGS. 5C and 5D are similar views of another spring strip embodiment.
Figure 5D:
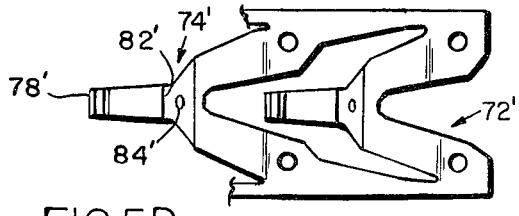

FIGS. 5C and 5D illustrate another spring strip embodiment 72' which has the same advantages as strip 72. This strip is composed of a series of springs 74'. In this version, the springs have longer noses 78'. Also their tails are substituted for by transverse channels 82' formed at the junctions of the spring legs and which project down below the general planes of the springs 74'. A dimple 84' is formed at the underside of each such channel. The strip functions in more or less the same way as strip 72.

Turning now to FIGS. 4, 6C and 7B, when each key 22 is depressed, its short posts 116 engage the free ends of the tongues 104 formed in the top wall of the guide strip supporting that key. Since those tongues are flexible and resilient, they function as shock absorbers which absorb the impact of the depressed key. Thus these elements also contribute to the operator feedback provided by the keyboard. In addition, they minimize the vibration produced by the keyboard when in use.

Figure 8A:
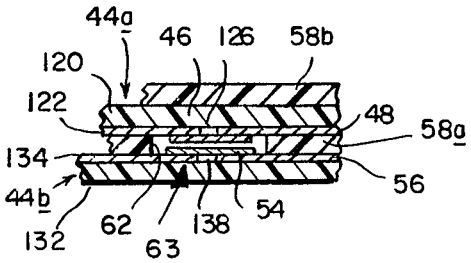
FIGS. 8A and 8B are sectional and top plan views with parts broken away respectively illustrating the construction of the switches in the FIG. 1 terminal.
Figure 8B:
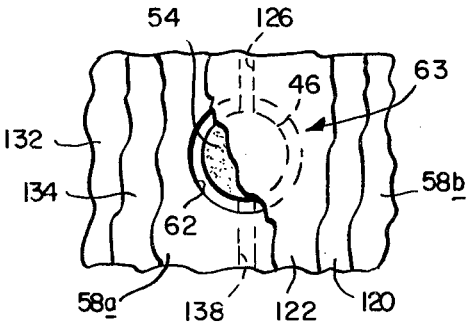

Referring now to FIGS. 8A and 8B, the flexible printed circuit assembly 42 specifically illustrated is specially designed to provide consistent and reliable electrical connections at all of the switches 63 defined thereby. To meet this objective, the circuit assembly 42 is formed quite differently from flexible touch pads, membrane-type touch panels and other such flexible switches already known in the art of which we are aware.

In the present arrangement, the upper section 44*a* of the flexible printed circuit 44 comprises a sheet substrate 120 of a suitable electrically-insulating flexible plastic material such as Mylar polyester. Affixed to the underside of that substrate 120 is a thin layer 122 of a conductive metal such as copper plated all over with solder. At the location of each switch 63 in the printed circuit assembly is a very thin conductive silver (carbon) contact disk which is plated onto the underside of the coated copper layer 122. This disk constitutes the switch contact 46 discussed above. Substantially the entire area of section 44*a* is covered by the copper layer 122 except along selected narrow etched paths 126 which extend over the surface of the substrate 120 and which serve to electrically isolate the contacts 46 from each other. The topology of those etched paths 126 is such as to establish separate electrical paths 48 from each plated contact 46 at each switch 63 to another contact or to an electrical terminal 52 on the printed circuit tabs 44*c* (FIG. 2), while maintaining the area of the copper layer 122 on the substrate 120 at a maximum.

The bottom section 44*b* of the flexible printed circuit 44 comprises a Mylar substrate 132 to which is adhered a thin layer 134 of a conductive metal such as copper coated all over with solder. Plated onto the coated copper layer 134 at each switch 63 is a small silver (carbon) contact disk of a relatively inert electrically-conductive metal such as silver. Each such disk constitutes a switch contact 54 which is located directly opposite the contact 46 of that switch 63. Also the copper layer 134 is etched away from the substrate to define a multiplicity of narrow paths 138 extending over the surface of the copper layer. These paths are also arranged so as to electrically isolate the contacts 54 at each switch position and to establish electrical paths 56 from each such contact to another contact or to one or more terminals 52 on the printed circuit tabs 44*c*.

Actually as described above, the printed circuit sections 44*a* and 44*b* comprise a single folded-over flexible printed circuit so that the substrates 120 and 132 are formed as a single sheet and the paths 126 and 138 are etched at the same time on that sheet. Thus the contact areas 46 are applied to one-half of the resultant flexible circuit, while the contact areas 54 are applied to the other half so that, when the flexible circuit is folded in half and interleaved with the sheet 58, the two sets of contacts 46, 54 are in register with the opening 62 in the spacer sheet 58*a* as noted above.

When the printed circuit assembly 42 is sandwiched between the key guide strips 92 and the base 18*a* , the contact areas at each switch position 63 are more or less isolated and therefore protected from dirt and corrosion that might degrade the electrical connections between the contacts when the associated key 22 is depressed. However, there is still no air cushion effect at the switches 63 because the air is vented from those switch positions through paths 126 and 138 on the printed circuit sections when the keys 22 are depressed.

Also, it is important to note that the flexible circuit section 44*a*, which is flexed when the keys are depressed to establish electrical contacts at the various switch position 63, carries copper plating 122 over substantially its entire area. This is in sharp contrast to other flexible circuits which have copper conductors only along narrow paths from one point to another on the substrate. This means that the stiffness and resilience of circuit section 44*a* is determined by the copper layer 122 which layer is insensitive to changes in temperature, humidity and the like, rather than by the plastic substrate 120 which is affected greatly by such atmospheric variations.

Moreover, the copper layers 122 and 134 maintain the shape of the printed circuit so that the positions of the switch contacts 46 and 54 can be located precisely on the circuit. The thickness of the spacer sheet 58*a* can also be controlled quite accurately as can the heights of the raised silver contacts 54 at each switch position 63. Resultantly, the present printed circuit assembly 42 has very uniform electrical and mechanical characteristics at all of its switch positions. In other words, when a selected amount of downward force is applied to the top of the assembly at a particular switch position 63, a consistent and reliable electrical connection is made between the contacts 46 and 54 at that position. Resultantly, the keys of the keyboard 10 initiate uniform electrical signals.

While we have shown in detail one specific flexible circuit construction, it should be understood that a conventional circuit may be employed, e.g. a Mylar substrate carrying printed circuit paths and contact areas of conductive silver.

In summary then, the electronic keyboard described herein is a great improvement over prior comparable keyboards in that it is composed of a relatively small number of different parts which are quickly and easily assembled without requiring any wiring steps at all to be performed at the different key locations on the keyboard. The present keyboard is composed of a minimum number of parts, none of which are loose or require pins or pivots or other linkages which could jam in use. In fact, the only moving parts are the keys 22 which simply slide in the key guide strips 92 and the springs 74 or 74' which flex against the flexible printed circuit assembly 42. Since the keys and key guide strips are made of plastic, they are more or less self-lubricating so that there is little tendency of the keys to stick, even in the presence of dirt and other debris which might tend to find its way into the keyboard. Needless to say, any such debris would not affect the simple flexing of the springs 74 or 74' and the layers of the printed circuit assembly.

The keyboard establishes very consistent reliable electrical contacts as its different switch positions and it emits a minimum amount of noise when in use. Yet the keyboard as a whole is relatively rugged and compact and meets all of the height standards set by the industry. As a consequence of these advantages, the keyboard should find wide acceptance in the marketplace.

It will thus be seen that the objects set forth above, among those made apparent from the preceding description, are efficiently attained, and, since certain changes may be made in the above method and in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. An electronic keyboard comprising:

A. a base,

B. a flexible printed circuit positioned on the base, said circuit defining a plurality of spaced-apart electric switches arranged in one or more rows on the base, each switch remaining open until the printed circuit is depressed at the location of that switch, C. one or more similar spring strips positioned against the printed circuit, each said strip extending opposite a plurality of switches in each switch row on the base defined by the printed circuit, each spring strip comprising a lengthwise series of spring members each of which actuates an underlying switch in the underlying switch row when moved from a relaxed position to a stressed position and each spring strip in each row being separate from the spring strips extending along adjacent rows on the base, D. one or more similar key guide strips positioned opposite each row of spring strips, each key guide strip defining a lengthwise series of key guides for movably mounting keys opposite underlying spring members, E. means for mounting each key guide strip separately to the base so as to fix the positions relative to the base of the key guide strips and the spring strips and printed circuit portions in each row on the base, and F. similar keys movably mounted in the key guide strips so as to engage underlying spring members, each said key being supported in a first position by the engaged spring member when that member is in its relaxed position, said key being movable to a second position so as to move the engaged spring member to its said stressed position, said spring strips, key guide strips and keys being interchangeably positionable on and mountable to any of the switch rows on said base.

2. The keyboard defined in claim 1 wherein the printed circuit comprises:

A. an electrically insulating substrate, and

B. an electrically conductive coating affixed to a face of the substrate except along relatively narrow paths which define said switches and connections thereto, said coating occupying the major portion of the substrate face so that the physical characteristics of said circuit are determined primarily by the physical characteristics of the coating.

3. The keyboard defined in claim 2 wherein said narrow paths provide venting conduits for the switch locations when the printed circuit is depressed at those locations.

4. The keyboard defined in claim 1 wherein a single key is mounted to the key guide strip at a plurality of key positions defined thereby so that a plurality of switches are associated with said single key.

5. The keyboard defined in claim 1 wherein the printed circuit comprises:

A. a flexible electrically insulating substrate,

B. a first array of switch contacts formed on one face of the substrate,

C. a second array of switch contacts formed on said face, the contacts in each array being positioned so that when the substrate is folded over on itself to form superimposed layers, the contacts in the two arrays are in register, and D. a flexible electrically insulating spacer sheet positioned between the substrate layers, said sheet having openings in register with each pair of contacts so that the contacts of each pair can touch when the printed circuit is depressed at the location of each said contact pair.

6. The keyboard defined in claim 1 wherein each spring member comprises a cantilevered spring having:

A. one end anchored to the base opposite a key guide,

B. its opposite end engaging the key mounted in an adjacent key guide in the same row, and C. a portion intermediate said ends located opposite the associated switch which is actuated by that spring member.

7. The keyboard defined in claim 1 wherein the mounting means comprise

A. a plurality of anchoring posts depending from each key guide strip,

B. an array of registering holes in the base, printed circuit and each said spring strip, said holes being positioned to receive said posts, and C. means for retaining said posts in the holes in said base.

8. The keyboard defined in claim 1 wherein

A. the base includes a floor which ramps up from the front to the rear of the base, and B. adjacent rows of spring strips and key guide strips are mounted to the base at different elevations on said base floor.

9. The keyboard defined in claim 8 wherein the ramp angle of the base floor varies from the front to the rear of the base so one row of key guide strips and keys is oriented at a different angle from an adjacent row of key guide strips and keys.

10. The keyboard defined in claim 1 and further including

A. first retaining means on each of said key guide strips; and

B. second retaining means on each of said keys, said first and second retaining means coacting to movably retain said keys in their key guides.

11. The keyboard defined in claim 10 wherein

A. said first retaining means comprise one or more openings formed in each key guide strip adjacent each key guide defined thereby, and B. the second retaining means comprise one or more elongated resilient clips depending from each said key, each said clip engaging in an opening adjacent the key guide in which said each key is movably mounted.

12. The keyboard defined in claim 1 and further including

A. first buffer means on each of said key guide strips and

B. second buffer means on each of said keys, said first and second buffer means coacting when each key moves to its second position so as to buffer the movement of said each key.

13. The keyboard defined in claim 12 wherein

A. the first buffer means comprise at least one flexible resilient tongue formed in each key guide strip adjacent each key guide defined thereby, and B. the second buffer means comprise at least one projection depending from each said key, each said projection engaging the free end of a tongue adjacent the key guide in which said each key is movably mounted.

14. An electric keyboard of the type having a base, a flexible circuit defining a plurality of switches and a plurality of key means for actuating the switches, A. said base comprising a surface having a plurality of faces at least one of which is oriented in a different plane from but intersecting another of said faces, and B. wherein (1) the flexible circuit is disposed on said surface and extends over all of said faces, and (2) said a plurality of key means is disposed on the flexible circuit and extends over all of said faces.

15. The keyboard defined in claim 1 wherein

A. the base includes a ramp whose ramp angle varies from the front to the rear of the base, and B. adjacent rows of spring strips and key guide strips are mounted to the base at different elevations on said base so that one row of key guide strips and keys is oriented at a different angle from an adjacent row of key guide strips and keys.

16. The keyboard defined in claim 14 wherein the key means for actuating the switches at different levels have substantially the same shape, but are tilted differently by the base surface faces.

* * * * *